United States Patent [19]

Peters et al.

[11] 4,360,340

[45] Nov. 23, 1982

[54] THERMAL DEVELOPER FOR DRY SILVER PHOTOGRAPHIC PAPER

[75] Inventors: Hans-Werner Peters, Raisdorf; Klaus Weiss, Kirchbarkau, both of Fed. Rep. of Germany

[73] Assignee: Dr. Ing. Rudolf Hell GmbH, Fed. Rep. of Germany

[21] Appl. No.: 156,403

[22] Filed: Jun. 4, 1980

[30] Foreign Application Priority Data

Jun. 8, 1979 [DE] Fed. Rep. of Germany ..... 2923260

[51] Int. Cl.[3] ..... F27B 9/28; F26B 13/00

[52] U.S. Cl. ..... 432/59; 432/8

[58] Field of Search ..... 432/8, 59, 60

[56] References Cited

U.S. PATENT DOCUMENTS 3,152,794 10/1964 Alexeff et al. ..... 432/59
3,464,680 9/1969 Nakamura et al. ..... 432/59
3,782,889 1/1974 Panico ..... 432/59
3,893,245 7/1975 Knechtel et al. ..... 432/59
4,212,631 7/1980 Franke et al. ..... 432/60

*Primary Examiner*—John J. Camby
*Attorney, Agent, or Firm*—Hill, Van Santen, Steadman, Chiara & Simpson

[57] ABSTRACT

The drum for passing photographic paper along the surface of a heating trough is reversibly rotatable to maintain a high coefficient of friction between the exterior fibrous surface of the drum and the carrier undersurface of the paper. Drum rotation is reversed in the direction opposite to the transport of paper during periods between successive developments so as to brush the outer tips of the drum fibers against the surface of the trough, deflecting them in the direction of paper transport. The fiber surface of the drum may be set accordingly during manufacture by a grinding wheel rotated oppositely and concurrently with the drum to be finished, but at a much greater speed than the drum. The grinding wheel serves to incline the fiber tips so as to be initially directed in the direction of paper passage along the trough.

3 Claims, 2 Drawing Figures

THERMAL DEVELOPER FOR DRY SILVER PHOTOGRAPHIC PAPER

BACKGROUND OF THE INVENTION

1. Field of the Invention

The invention relates to a heat treatment device in the development of photographic paper.

2. The Prior Art

The processes for the development of photographic material often include heat treatment stations. The recording material there is guided along heating surfaces, smoothing devices, etc. The recording material is usually a paper carrier with a specially prepared coating for picture recording. Typically, the paper to be developed contains an exposed dry silver material coating.

Presently known devices for the heat treatment of photographic paper utilize a drum which is covered with fibrous material, such as a textile, felt, or synthetics, or an electrostatically charged nap. The fibrous surface of the drum runs along a heated trough which is curved to be coextensive with the outer radius of the drum and extend along part of the circumference of the drum. In the development process, the photographic paper passes between the drum and the heating trough or surface with the dry silver coated side facing the trough, which is usually metal. The drum serves to pass the paper along the trough because the coefficient of friction of the paper against the drum is higher than the coefficient of coating against the trough. It has been discovered, however, that this arrangement for the transport of paper along the trough often breaks down and that the coefficients of friction become identical or even reversed. A manner by which this occurs is due to the slight tendency of the relatively cold coated side to stick against the heated trough surface; while the drum surface fibers contacting the other side of the paper become slowly displaced toward the direction opposite the rotation of the drum during the periods when the drum runs against the surface of the trough between developments. Inclination of the exterior fibrous surfaces of the drum away from the direction of rotation produces the coefficient of friction between the paper and the drum. This deterioration of the relative frictional settings desired for the drum and trough device alters the heat treatment process carried on by the trough, making the developing system less reliable.

SUMMARY OF THE INVENTION

The present invention serves as a safeguard against deterioration of the desired relative frictions occurring when photographic paper is transported between a drum covered with fibrous material and a stationary, heated surface partially enclosing the drum. To this end, rotation of the drum is arranged to be reversed during the periods between passage of developments along the trough. The fibers at the outer surface of the drum are displaced due to engagement with the heated surface in a direction away from the rotation of the drum, but in the direction of drum rotation when photographic paper is being passed against the heated surface.

The fiber-covered surface of a drum of this type may have the fibers inclined in a preferred direction by means of a high-speed grinding wheel. The grinding wheel passes in engagement with the exterior surfaces of the drum and is rotated in a direction opposite of the rotational direction of the drum.

DESCRIPTION OF THE PREFERRED EMBODIMENTS

Figure 1:
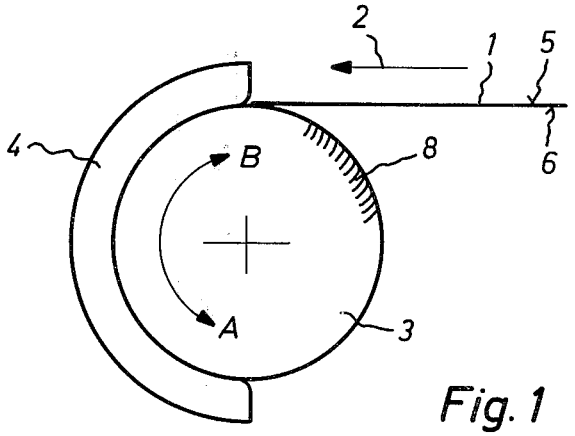
FIG. 1 is a schematic diagram of a drum and heated trough arrangement of the subject invention.

The heat treatment of photographic paper may occur in the development process. With reference to FIG. 1, picture recording material, such as photographic paper, numeral 1 has been exposed in a camera and is, for development purposes, being conducted by means of transport rolls (not shown) in the direction 2 for heat treating. The paper is passed between a rotary driven drum 3 having a fibrous exterior, preferably felt, and a heated surface or trough element 4. The drum rotates in the direction A and passes the paper 1 along the trough by means of the frictional engagement of the fibers 8 against the undersurface or carrier side 6 of the paper. The upper surface 5 of the paper is coated with picture recording material and faces against a corresponding surface of the trough 4. The surface of the trough engaging with the coated side 5 of the paper extends along a circular path so as to be coextensive with the exterior surface of the drum 3 partly around the circumference of the drum.

The paper 1 is transported along the heating trough 4 when the coefficient of friction between the outer fibers 8 of the drum and the carrier side of the paper 1 is greater than the coefficient of friction between the coated side 5 and the trough 4. Generally, however, these two coefficients of friction are close to one another so that even a slight reduction in the coefficient of friction at the drum fibers can disrupt transport of the paper, even to the point where passage of the paper along the trough 4 stops.

In order to preclude deterioration of the frictional engagement between the drum and the carrier side 6 of the paper, the rotational drive for the drum 3 is made reversible such that the drum may be rotated in the direction B. Sheets of paper being developed may be passed consecutively against the heating trough 4 in the direction 2; however, there are relatively long pauses between when developments pass to the trough 4. The ratio of time when photographic paper 1 is being passed against the trough 4 and the time between sheet passage before the next development is being passed by the drum 3 along the trough is often approximately 1:10. During this intermediate period, the drum is rotated in the direction B so as to incline the radially outer tips of the fibers 8 in the direction A as the drum surfaces passes against the stationary surface of the trough 4. Thus, when a successive development arrives, the surface fibers 8 have their tips arranged in the direction A maintaining the high coefficient of friction between the drum 3 and the carrier side 6. Drive for the drum 3 is reversed in the direction A to pass the paper 1 against the heating trough 4 for the development operation.

Figure 2:
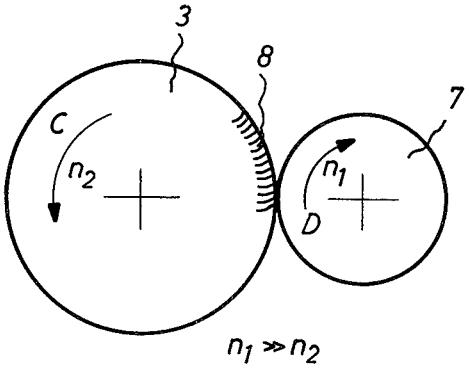
FIG. 2 is a schematic diagram of a grinding wheel setting exterior inclinations of the fibers for the drum of FIG. 1 in accordance with the subject invention.

With reference to FIG. 2, there is shown a manner of finishing the fiber surface 8 for a drum 3 of the type described above. To finish the exterior surface, a grinding wheel 7 is rotated concurrently with the drum 3. The speed $n_1$ of the grinding wheel is, however, much greater than the speed $n_2$ of the drum 3. The direction of rotation C of the drum is opposite of the rotational direction D of the wheel 7, such that the outer tips of the fibers are displaced by the grinding wheel at angles of inclination pointing the tips in the direction C. The direction C preferably corresponds to the direction A described above so that the finishing process performed by the grinding wheel 7 serves to initially increase the frictional capability of the fibrous covering for immediate use in conjunction with the heating trough 4 in the process described above. The periodic reversal of the drum 3 in the development operation as described above maintains this frictional setting for the surface fibers 8 of the drum 3.

Although various minor modifications may be suggested by those versed in the art, it should be understood that we wish to embody within the scope of the patent warranted hereon all such modifications as reasonably and properly come within the scope of our contribution to the art.

We claim as our invention:

1. Improved apparatus for heat treating sheets of photographic material being passed in spaced succession to a heating station, said heating station having a rotary-driven drum, the exterior surface of which is fibrous for engaging the underside of each sheet with the fibers to conduct the sheet in a forward direction of rotation of said drum, and a stationary, heated surface adjacent to and coextensive with the exterior surface of said drum along the portion of a drum circumference for engaging with the upper surface of each sheet being passed through the heating station by said drum, the improvement commprising:

means for rotating said drum in the reverse direction during the times between transport of sheets through said heating station, so as to displace the fibers at the exterior surface of said drum against said heated surface such that the outer tips of the fibers are inclined in the forward direction of rotation of said drum.

2. The apparatus of claim 1, wherein the exterior surface of said drum is of felt material.

3. The apparatus according to claim 1, wherein the outer tips of the fibers of said drum are initially inclined in a forward direction of rotation of said drum.

* * * * *